US007866237B2

(12) United States Patent
Vesentini

(10) Patent No.: US 7,866,237 B2
(45) Date of Patent: Jan. 11, 2011

(54) SCREWING HEAD FOR SCREWING THE RING NUT OF A SMALL TRIGGER-TYPE PUMP ON A VESSEL

(75) Inventor: Renzo Vesentini, Marmirolo (IT)

(73) Assignee: Rejves S.r.l., Marmirolo (MN) (IT)

( * ) Notice: Subject to any disclaimer, the term of this patent is extended or adjusted under 35 U.S.C. 154(b) by 422 days.

(21) Appl. No.: 11/919,186

(22) PCT Filed: May 9, 2006

(86) PCT No.: PCT/EP2006/004300

§ 371 (c)(1),
(2), (4) Date: Oct. 24, 2007

(87) PCT Pub. No.: WO2006/122670

PCT Pub. Date: Nov. 23, 2006

(65) Prior Publication Data

US 2010/0018158 A1 Jan. 28, 2010

(30) Foreign Application Priority Data

May 19, 2005 (IT) ..... PR2005A0024

(51) Int. Cl.
*B25B 23/14* (2006.01)
*B67B 3/20* (2006.01)

(52) U.S. Cl. ..... 81/467; 53/317

(58) Field of Classification Search ..... 81/467, 81/57.22, 57.36; 53/317, 331.5
See application file for complete search history.

(56) References Cited

U.S. PATENT DOCUMENTS

| | | | | | |
|---|---|---|---|---|---|
| 2,069,882 | A | * | 2/1937 | Hall | 81/467 |
| 3,848,488 | A | * | 11/1974 | Weisenburger | 81/475 |
| 4,086,747 | A | * | 5/1978 | Gorton et al. | 53/340 |
| 4,909,105 | A | * | 3/1990 | Namiki et al. | 81/57.36 |
| 5,467,527 | A | | 11/1995 | Zanini et al. | |
| 5,479,762 | A | | 1/1996 | Bliss et al. | |
| 5,584,161 | A | | 12/1996 | Zanini et al. | |

FOREIGN PATENT DOCUMENTS

| | | | |
|---|---|---|---|
| FR | 2658587 | A | 8/1991 |
| WO | WO 2005/007556 | A1 | 1/2005 |

OTHER PUBLICATIONS

International Search Report; Aug. 11, 2006.

* cited by examiner

*Primary Examiner*—David B Thomas
(74) *Attorney, Agent, or Firm*—Hedman & Costigan, P.C.; James V. Costigan

(57) ABSTRACT

The invention deals with the field of screwing heads for small trigger-type pumps or triggers and namely for applying, on vessels, triggers equipped with a threaded securing ring nut (2). This screwing head (1) is rotated around a vertical axis through a permanent magnet-type clutch and comprises four rollers (5) which tighten the toothed ring nut (2) when screwing it; said rollers (5) are supported by vertical arms (4) whose axes are arranged at 90° one from the other on a circumference with its center on the rotation axis of the screwing head. The vertical arms (4) and the four rollers (5) are simultaneously carried along a radial direction towards said ring nut through an oscillating movement.

3 Claims, 3 Drawing Sheets

SCREWING HEAD FOR SCREWING THE RING NUT OF A SMALL TRIGGER-TYPE PUMP ON A VESSEL

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1) Field of the Invention

The present invention deals with a screwing head for screwing the ring nut of a small trigger-type pump, commonly called trigger, on a vessel.

2) Description of Related Art

As known, a trigger is equipped with a float composed of a small pipe aimed to be inserted into the vessel, further comprising an externally toothed ring nut which is free of rotating with respect to the trigger body and is internally threaded to be associated with the corresponding threading obtained on the vessel neck to be plugged.

The screwing head is used in connection with a carousel-type (rotating) or a linear-type machine and, next to every machine workstation, a washer is provided which supports the vessel to be screwed, while the screwing head comprises clamping means of the trigger ring nut which screw it onto said vessel.

The head is actuated by a cam which handles a slide which lowers the clamping means, generally composed of a pair of rollers which are kinematically connected through two arms with the motoring device of the screwing head so that, once arranged in contact with the ring nut, they screw it onto the vessel.

Following the tightening, to avoid that the torque impressed onto the head exerts an action which is greater than the threading sealing limit, a permanent magnet-type clutch takes care of detaching the rotation action to the rollers.

A prior art inconvenience which uses only two tightening rollers, is that, to avoid sliding between these latter ones and the knurled ring nut, a certain energic action must be created, namely a certain pressure onto the ring nut, creating distortions and abrasions thereon.

A prior art proposed solution to solve the above inconvenience has been doubling the number of rollers acting on the ring nut in order to reduce the local contact pressure, though keeping unchanged the number of oscillating arms for approaching the ring nut; this solution modifies the operating angle of each roller onto the ring nut (not radial any more) at the same time creating slidings between components and unpleasant abrasions to the knurled part of the ring nut.

BRIEF SUMMARY OF THE INVENTION

Object of the present invention is removing the above inconveniences by providing a screwing head for trigger which enables an optimum ratio of the operating pressures between rollers and ring nut and allows keeping a suitable operating angle between the two components.

These objects and advantages are all obtained by the screwing head for trigger, which is the subject matter of the present invention, which is characterised in what is included in the claims which follow.

BRIEF DESCRIPTION OF THE SEVERAL VIEWS OF THE DRAWINGS

Characteristics and advantages will be better pointed out by the following description of a preferred embodiment, shown merely as a non-limiting example, in the attached tables of drawing, in which.

DETAILED DESCRIPTION OF THE INVENTION

Figure 1:
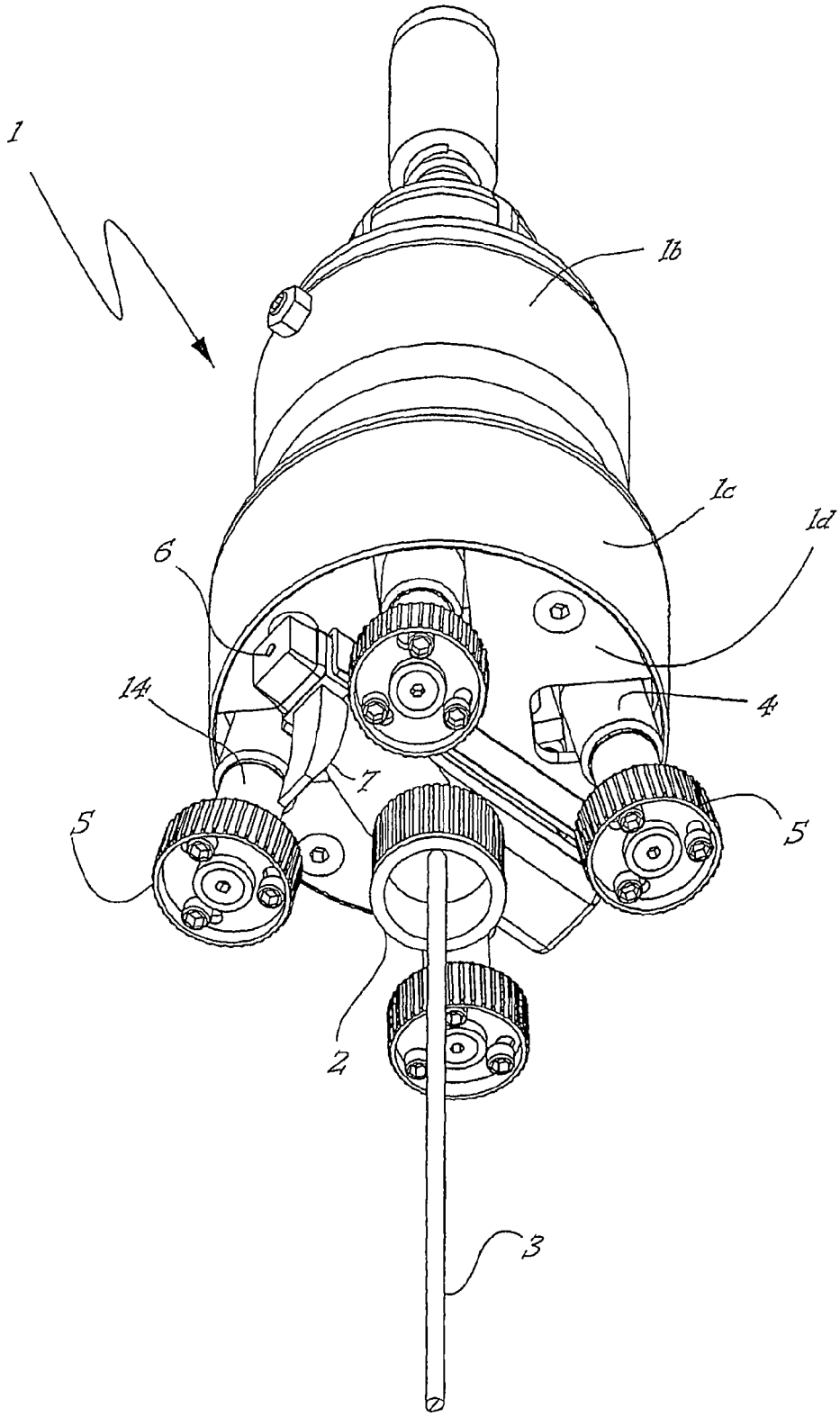
FIG. 1 shows a perspective view of the screwing head for triggers in a configuration with open rollers.

With reference to FIG. 1 a screwing head 1 is shown as a whole; under it, a trigger 6 is located, equipped with a ring nut 2, which will be screwed onto a vessel, not shown.

The trigger, of a known type, further comprises the control lever or trigger 7 and the floating cannula 3; the ring nut 2 is internally threaded to be screwed onto the vessel neck and externally has a toothed or knurled crown.

The screwing head 1 is rotated around a vertical axis 1*a* and comprises four vertical arms 4, each one carrying a (toothed or knurled) roller 5.

Precisely, the vertical axes 4*a* of the four arms 4 are located 90° one to the other, on a circumference with its centre on the vertical rotation axis 1*a*.

Figure 2:
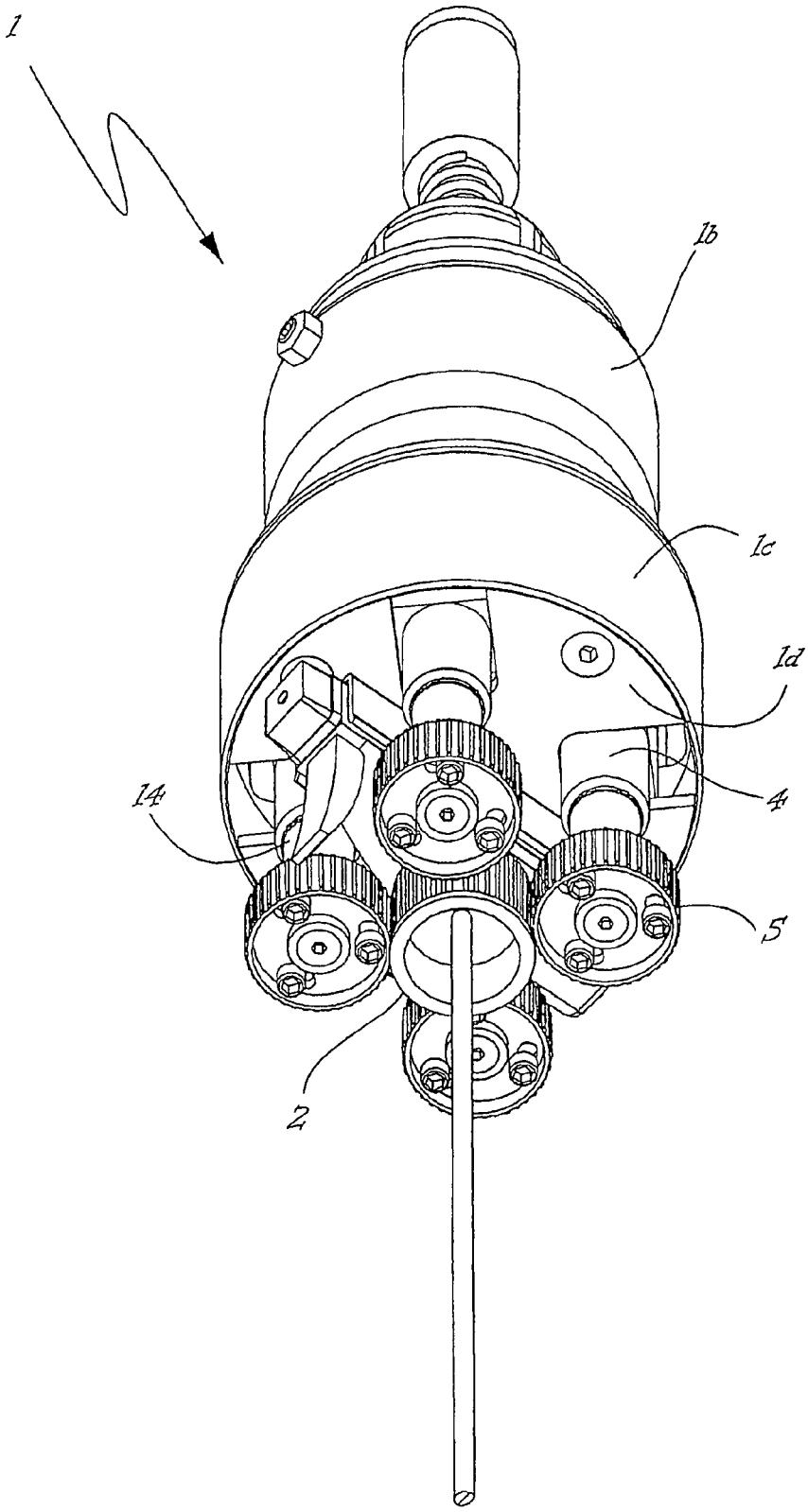
FIG. 2 shows the screwing head for triggers in a configuration with tightened rollers around the ring nut of a trigger.
Figure 3:
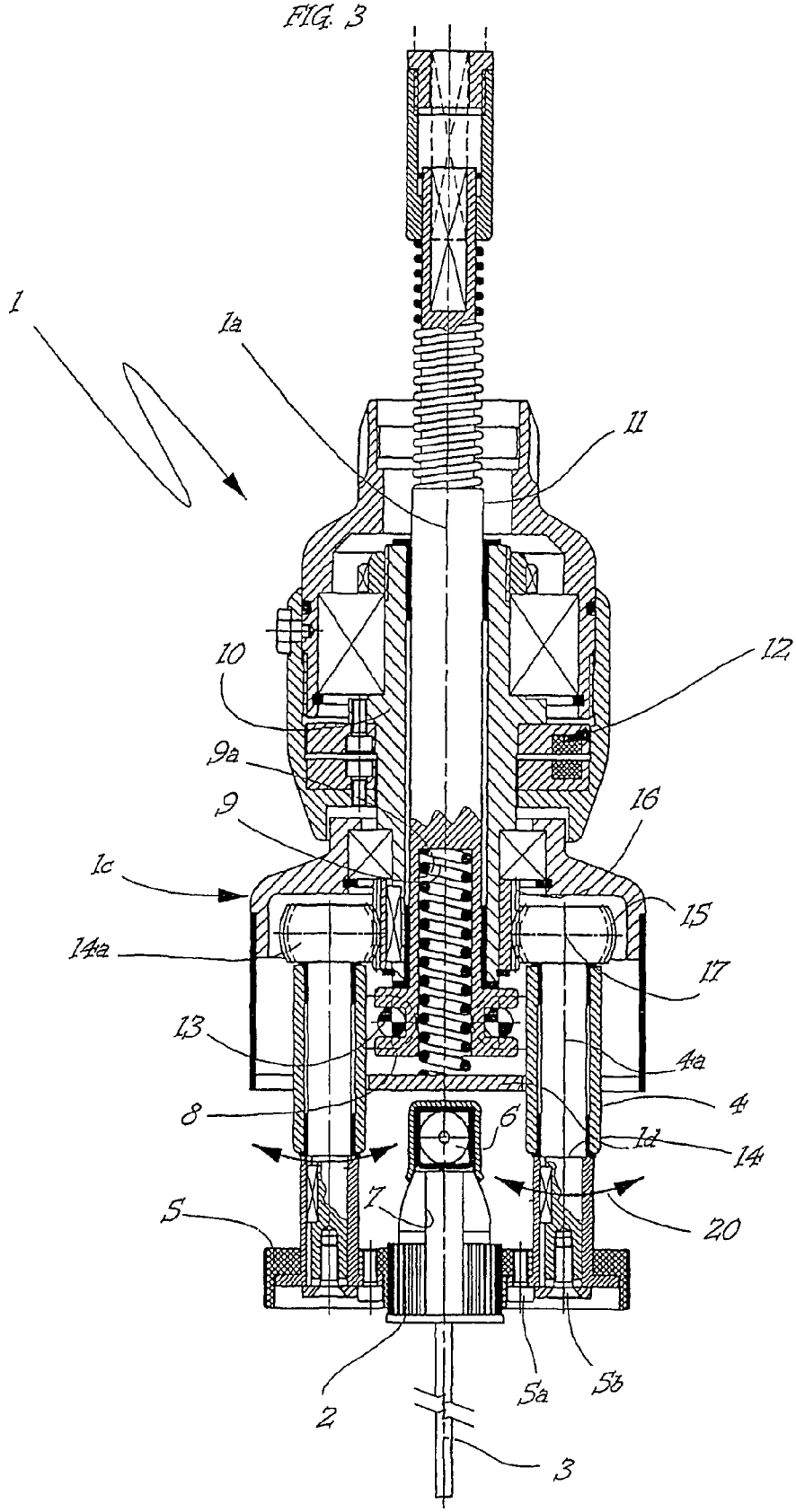
FIG. 3 shows the screwing head in a medium section of FIG. 2.

The four vertical axes 4*a* can simultaneously oscillate in order to bring the four rollers from an open position, FIG. 1, to a tightening position around the ring nut of the trigger, as shown in FIGS. 2 and 3.

The configuration normally assumed by the screwing head is the open one, namely the one related to the device rest phase, such phase preceding the tightening of the ring nut 2 onto the vessel.

The system which allows bringing the rollers 5 from a rest position to their tightening position will now be described.

This screwing head 1 is composed of an upper body 1*b* and a lower bell 1*c* rotating together around the rotation axis 1*a* through a permanent magnet-type clutch 12, inserted in the upper body 1*b*, which rotates, through the below described kinematism, the rollers 5 around the axis 4*a*.

An hollow shaft 10 is inserted in the upper body and in the lower bell through suitable bearings.

Inside the hollow shaft 10 a stem 11 is housed, which can vertically translate along axis 1*a* moved by a cam kinematism of a known type and not shown in the figure.

It follows that, while the hollow shaft 10 rotates, the stem 11 will be free of sliding inside it, recalled by the mentioned cam.

The terminal part of the stem 11, namely the one towards a base 1*d* for closing the bell 1*c*, ends with four forks 8 with four recesses which allow housing as many pins 13 which are part of the previously described arms 4.

A spring 9 is placed in a hole 9*a* of the stem 11 and abuts against the base 1*d* in order to keep said stem in contact with the corresponding control cam (not shown) and its function is guaranteeing a radial pressure onto the ring nut.

When the cam pushes the stem 11 downwards, the fork 8 drags each pin 13 being an integral part of the arm 4, and the arm 4 hinged in the point 17, an oscillation of each roller 5 follows, around said point 17 as pointed out by reference 20.

The stem 14 is connected with the hollow shaft 10 through a toothed kinematism, since on the end part of the hollow shaft 10, a toothed crown 16 is keyed, which engages a corresponding ball-shaped toothing 15 obtained on a bulb 14*a* of the stem 14 (opposite to the end part connected to the roller 5).

It follows that the translation action given by the stem 11 impresses a rotation to the stem 14, since it is dragged by the corresponding arm 4.

This will make the rollers 5 radially open, which in such a way will be detached from the ring nut 2.

The clutch is engaged for detaching from the hollow shaft 10 and therefore stopping the torque provided to the rollers 5 and the ring nut 2, avoiding to damage the threaded connection and the ring nut 2.

Summarising, a plugging head 1 is available for a trigger having four rollers 5 simultaneously moved along a radial direction, and from four different points of the screwing head, towards the ring nut 2 of the plug which will have to be screwed onto the vessel.

The action is imparted through the combination of a rectilinear movement of the stem 11 which directly operates on the arms 4 and of a rotation of the stem 14, inside the arm 4, performed with the above cited toothed kinematism between toothing 16 of the hollow shaft 10 and toothing 15 of the bulb 14*a*.

The stem 11 is driven by a cam, while the action of keeping the position is guaranteed by a thrust spring 9 placed in the opposite direction.

Obviously, the radial displacement of the four rollers in order to go into the crown tightening position can be realised with other kinematisms adapted to make the rollers intervene radially towards the rotation axis of the ring nut, without departing from the scope of the below listed claims.

Moreover, the four rollers 5 can be arranged on a circumference with its centre on the rotation axis at a variable angular distance from the previously described one, though keeping the concept of simultaneous radial displacement, namely the vertical axes 4*a* of the four arms 4 will be able to be arranged at different angles on the circumference with its centre on the vertical rotation axis 1*a*.

The invention claimed is:

1. Screwing head (1) for screwing a ring nut (2) of a trigger on a vessel comprising:

a. an upper body (1*b*) and a lower bell (1*c*) adapted to be rotated together around a rotation axis (1*a*) by a rotating permanent magnet-type clutch (12), that is inserted in said upper body (1*b*), b. four rollers (5) placed around the respective vertical axes (4*a*) of four vertical arms (4), said vertical arms (4) being capable of simultaneously being oscillated in order to bring said four rollers (5) from an open position to a tightening position around the ring nut of the trigger, c. a hollow shaft (10) inserted in the upper body and in the lower bell, d. a first stem (11), housed inside said hollow shaft (10) which vertically translate along axis (1*a*); a terminal part of said first stem (11), that is located towards a base (1*d*) for closing said lower bell (1*c*) said terminal part ending with four forks (8) having four recesses which house pins (13), e. a second stem (14), inside said vertical arms (4) that are connected with an end part of said hollow shaft (10), in which a toothed crown (16) is keyed to and engages a corresponding ball-shaped toothing (15) mounted on a bulb (14*a*) of said second stem (14), opposite to said end part of said second stem (14) which is connected to roller (5) wherein an action imparted by said first stem (11) causes said second stem (14) to rotate by a corresponding vertical arm (4), making rollers (5) radially open, said rollers (5) being detachable from ring nut (2).

2. Screwing head (1), according to claim 1, characterised in that the vertical axes (4*a*) of the four vertical arms (4) are positioned at 90° to said rollers(5) along a circumference having its center on the vertical rotation axis (1*a*).

3. Screwing head (1), according to claim 1, characterised in that the vertical axes (4*a*) of the four arms (4), are positioned on a circumference according to a variable angular distance.

* * * * *